United States Patent [19]

Boonstra et al.

[11] 4,397,774

[45] Aug. 9, 1983

[54] METHOD OF PREPARING RESISTANCE MATERIAL AND RESISTOR BODIES PRODUCED THEREWITH

[75] Inventors: Alexander H. Boonstra; Cornelis A. H. A. Mutsaers, both of Eindhoven, Netherlands

[73] Assignee: U.S. Philips Corporation, New York, N.Y.

[21] Appl. No.: 178,044

[22] Filed: Aug. 14, 1980

Related U.S. Application Data

[63] Continuation of Ser. No. 950,642, Oct. 11, 1978, abandoned.

[51] Int. Cl.[3] ..... H01B 1/06

[52] U.S. Cl. ..... 252/518; 252/512; 29/610 R; 75/224

[58] Field of Search ..... 252/518, 512; 427/101, 427/126; 428/539; 338/20, 21, 22 R; 29/610 R; 75/200, 224, 206

[56] References Cited

U.S. PATENT DOCUMENTS

| | | | |
|---|---|---|---|
| 3,052,573 | 9/1962 | Dumesnil | 252/518 X |
| 3,560,410 | 2/1971 | Schubert | 252/518 X |
| 3,679,607 | 7/1972 | Angus et al. | 252/518 |
| 3,778,389 | 12/1973 | Kasanami et al. | 252/518 X |
| 3,798,063 | 3/1974 | Decraene | 252/518 X |

*Primary Examiner*—J. L. Barr

*Attorney, Agent, or Firm*—Norman N. Spain

[57] ABSTRACT

A method of preparing resistance material in accordance with which metal oxides and/or metal oxidic compounds are heated together with a binder and, possibly, metal. A resistor having a temperature coefficient which is low and independent of the dilution, that is to say the level of the resistance value, is obtained by choosing particles which are smaller than 100 nm and vary within a very narrow range only as the starting material.

2 Claims, No Drawings

METHOD OF PREPARING RESISTANCE MATERIAL AND RESISTOR BODIES PRODUCED THEREWITH

This is a continuation of application Ser. No. 950,642, filed Oct. 11, 1978 and now abandoned.

The invention relates to a method of preparing resistance material consisting of a mixture of metal oxides and/or metal oxidic compounds and, possibly, metals, together with a binder.

Such a resistance material is, for example, disclosed in U.S. Pat. No. 3,778,389. To prepare said resistance material two or more oxides, possibly together with a metal, are heated together with a glass frit powder as a binder. By varying the ratio of, for example, two oxides, it is possible to obtain a variation in the resistance value, but in particular by varying the ratio of the resistance material to the binder it is possible to obtain a series of resistance values, varying, for example, from $10–10^6$ Ohm.cm.

During these operations it is not possible to control the temperature coefficient of the resistance independently. Some compounds have a metallic conductivity, the resistance value increasing linearly with the temperature and other compounds have a semi-conductor characteristic, the resistance varying in accordance with an e-function and decreasing at an increasing temperature.

It appears that, if a given resistance value having a certain, low temperature-coefficient of the resistivity (TRC) is adjusted positively or negatively for a given ratio between a chosen conductive component and a binder not only the level of the resistance value changes when the ratio of the conductor to the binder is changed but in addition a different value of TCR is obtained. This is clearly illustrated in the tables 1 and 4 of the above-mentioned United States Patent Specification.

It is an object of the invention to provide a resistance material by means of which it is possible to provide a series of resistance values without considerably changing the value of the TCR, the TCR being adjustable to a given, preferably very low, value.

The method of preparing resistance material in accordance with which an admixture of one or more metal oxides and/or one or more metal oxidic compounds is heated with an essentially non-reacting binder and, possibly, together with a metal, is characterized, in accordance with the invention, in that the metal, the metal oxides and the metal oxidic compounds have a particle size of not more than 100 nm and a maximal deviation in the particle size, depending on the level of the TCR of the bulk material, varying from not more than ± 10% at a TCR level of the bulk material of $4000\times10^{-6}$.°C.$^{-1}$ to not more than ±40% at a TCR level of the bulk material of $1000\times10^{-6}$.°C.$^{-1}$, in both cases at a maximum permissible deviation in the TCR of the final product of $\pm50\times10^{-6}$.°C.$^{-1}$.

The invention is based on the recognition that a different type of conduction occurs in resistance material at the surface compared to the conduction in the bulk material. At the surface, for example, the conduction may be of the semiconductor type (with a negative TCR) and in the bulk material of a metallic character, having as a rule a positive TCR. As a result the average particle size and the maximal deviation therein greatly influence the TCR, because the ratio of the surface conduction to the conduction in the bulk material of the particles is a function of the particle size.

The measure according to the invention means that starting material having a small and uniform particle size must be used.

U.S. Pat. No. 3,679,607 discloses a resistance material obtained from powder in which the size of the crystallites is smaller than 50 nm, the particles itself, however, being considerably larger. The effect of the invention is, however, definitely not achieved therewith as the spread in the crystallites can be very large and, furthermore, the crystallites recrystallize during firing to larger crystallites.

There are various manners to realize the measure of the invention. A possibility for obtaining $RuO_2$-particles which satisfy the above-defined specification consists in that a solution of a ruthenium compound is evaporated to dryness on finely dispersed quartz powder, the particles coated thus are heated in an atmosphere containing oxygen, causing the ruthenium compound to be converted into $RuO_2$, whereafter the quartz core is dissolved by means of HF. The choice of the particle size of the quartz powder and of the quantity of ruthenium compound deposited on the particles enable varying the ultimate particle size of the $RuO_2$ and, consequently, the level of the TCR.

A possibility of preparing $Pb_2Ru_2O_7$ with a uniform particle size is a precipitation reaction of an alkali ruthenate solution with a solution having an excess of a lead compound. The PbO formed during firing prevents the crystallites from growing. The excess of PbO can be removed after firing by means of nitric acid.

The average particle size and, consequently, the level of the TCR can be adjusted by a suitable choice of the concentrations of each of the reaction components, but of the firing temperature and/or the duration of the firing process in particular.

The metal oxidic powders thus obtained are processed in known manner to resistance material and to resistors bodies by means of an essentially non-reacting, vitreous binder or a binder consisting of a synthetic resin material.

The resistance value can be adjusted by the choice of the ratio of the powder to the binder. The invention offers the possibility of preparing a full range of resistance values with a substantially uniform TCR value. Alternatively, it is possible to prepare a resistance component having a negative TCR with a resistance component having a positive TCR, in the form of a powder, for adjusting a given TCR, for example $<100\times10^{-6}$.°C.$^{-1}$.

The invention will be further explained with reference to the following examples.

EXAMPLE 1

1 g of $RuCl_3$ was dissolved in 25 ml of water and 25 g of silica powder ($SiO_2{\cdot}2H_2O$) was suspended in this solution. The suspension was ground for one hour in a ball mill and thereafter evaporated to dryness, while being stirred continuously, at approximately 80° C. The powder obtained was heated for 1 hour at 600° C. in air, cooled to room temperature and thereafter treated with a 20% HF-solution until the $SiO_2$ had dissolved. The suspension obtained was filtered off and the residue was dried at 100° C. It was ascertained, by means of X-ray diffraction photographs, that the particles obtained consist of pure $RuO_2$. The average particle size was 20 nm. By means of electron-microscopic observation an estimate was made of the spread in the particle size which was found to be very small—in the order of ±10%.

Pastes of $RuO_2$ and a powdered glass having a particle size of approximately 1 μm and having the following composition in weight %.

PbO: 71.7, $SiO_2$: 21.0, $B_2O_3$: 5.0, $Al_2O_3$: 2.3 were prepared from the particles thus prepared with the aid of benzylbenzoate in a number of weight ratios $RuO_2$:glass.

The pastes were spread in a layer approximately 30 μm thick on an alundum substrate, which had already been provided with Ag-Pd conductor contacts. The assembly was dried at approximately 200° C. and heated at 600° C. in air for 10 minutes. The following ratio's were composed, the resistance values R and values of the temperature coefficient TCR being measured at the achieved products.

| $RuO_2$:glass | R | TCR |
|---|---|---|
| 1:4 | 440 Ohm/□ | $+50 \times 10^{-6} \cdot °C^{-1}$ |
| 1:6 | 2,10 kOhm/□ | ≈0 |
| 1:8 | 34 kOhm/□ | $-65 \times 10^{-6} \cdot °C^{-1}$ |
| 1:10 | 520 kOhm/□ | $-80 \times 10^{-6} \cdot °C^{-1}$ |

EXAMPLE 2

An excess of 100 ml of 0.5 M lead nitrate was stirred into 400 ml of a 0.04 M potassium ruthenate solution at room temperature. The precipitate formed was filtered off, washed with 200 ml of $H_2O$, filtered again and dried at 150° C. Thereafter the powder was heated at 700° C. in air for 1 hour and, after cooling, the excess of PbO formed was removed by a treatment in 8N nitric acid. The residue was filtered off, washed and the wet residue was dispersed in water in a concentration of 5 g of $Pb_2Ru_2O_7$ per liter of water, a colloidal solution then being formed.

The particle size of the lead ruthenate was 30 nm and the maximal deviation was estimated at ±25% by means of an electron microscope photograph.

A lead ruthenate dispersion was added in a plurality of ratios to a suspension of the glass, defined in example 1 and having a particle size of approximately 1 μm, the suspension being processed, after drying, to pastes by adding, inter alia, benzylbenzoate. The pastes were spread on alundum substrates to form a wet coating of approximately 30 μm thick in the wet condition, dried at 200° C. and thereafter heated at 800° C. in air for 10 minutes. Supply leads were provided in the same manner as in example 1.

The following results were obtained:

| | | |
|---|---|---|
| glass + 2 wt. % $Pb_2Ru_2O_7$ | R:10 M Ohm/□ | TCR $+100 \times 10^{-6} \cdot °C^{-1}$ |
| glass + 5 wt. % $Pb_2Ru_2O_7$ | 150 kOhm/□ | $+180 \times 10^{-6} \cdot °C^{-1}$ |
| glass + 10 wt. % $Pb_2Ru_2O_7$ | 15 kOhm/□ | $+200 \times 10^{-6} \cdot °C^{-1}$ |
| glass + 20 wt. % $Pb_2Ru_2O_7$ | 1, 5 kOhm/□ | $+170 \times 10^{-6} \cdot °C^{-1}$ |

EXAMPLE 3

From the same quantities of an alkali ruthenate solution and a lead nitrate solution as defined in example 2 a precipitate was obtained which, after filtering, washing and drying was heated at 700° C. in air for 20 minutes. In the same manner as in example 2 the powder obtained was treated in nitric acid, filtered, washed, dispersed, processed to pastes and spread on a substrate. The size of the particles dispersed was 15 nm and had a very small maximal deviation. The substrates were heated in air at 750° C. for 10 minutes.

In this case the results obtained were as follows:

| | R | TCR |
|---|---|---|
| glass + 2 wt. % $Pb_2Ru_2O_7$ | 4, 5 M Ohm/□ | $-50 \times 10^{-6} \cdot °C^{-1}$ |
| glass + 5 wt. % $Pb_2Ru_2O_7$ | 90 kOhm/□ | $-30 \times 10^{-6} \cdot °C^{-1}$ |
| glass + 10 wt. % $Pb_2Ru_2O_7$ | 8, 0 kOhm/□ | $-60 \times 10^{-6} \cdot °C^{-1}$ |
| glass + 20 wt. % $Pb_2Ru_2O_7$ | 950 Ohm/□ | $+20 \times 10^{-6} \cdot °C^{-1}$ |

EXAMPLE 4

From the same quantities of an alkali-ruthenate solution and a lead nitrate solution as defined in Example 2 a precipitate was obtained which, after filtering, washing and drying, heating in air at 700° C. for 1 hour, treating by nitric acid and filtering off was first washed with acetone and thereafter dispersed in N-methyl-pyrrolidon to a concentration of 35 g of $Pb_2Ru_2O_7$ per liter of N-methyl pyrrolidon.

This dispersion was mixed with various quantities of a 20 weight % solution of a polysulfon in N-methyl-pyrrolidon. The pastes were spread on an alundum substrate and heated at 300° C. in air for 20 minutes. Contacts were applied in the same manner as defined in Example 1.

The results obtained are specified below; the quantities relate to the solid material in the paste from which the resistance material was made.

| | R | TCR |
|---|---|---|
| polysulfon + 35 wt. % $Pb_2Ru_2O_7$ | 620 Ohm/□ | $+110 \times 10^{-6} \cdot °C^{-1}$ |
| polysulfon + 20 wt. % $Pb_2Ru_2O_7$ | 3,4 kOhm/□ | $+90 \times 10^{-6} \cdot °C^{-1}$ |
| polysulfon + 14 wt. % $Pb_2Ru_2O_7$ | 140 kOhm/□ | $+60 \times 10^{-6} \cdot °C^{-1}$ |

What is claimed is:

1. In the method of preparing a resistance material by firing in an oxygen containing atmosphere at least one metal oxide and an essentially inert binder, the improvement wherein said metal oxides have an average particle size of not more than 100 nm and have a maximum deviation of particle size varying from ±10% at a TCR level of the bulk material of $4000 \times 10^{-6} \cdot °C.^{-1}$ to not more than ±40% at a TCR level of the bulk material of $1000 \times 10^{-6} \cdot °C.^{-1}$, the maximum deviation in the TCR of the final fired resistance materials being $\pm 50 \times 10^{-6} \cdot °C.^{-1}$.

2. The method of claim 1 wherein at least one metal having a particle size in the range set out for the metal oxides is also present.

* * * * *

UNITED STATES PATENT AND TRADEMARK OFFICE

CERTIFICATE OF CORRECTION

PATENT NO. : 4,397,774

DATED : August 9, 1983

INVENTOR(S) : ALEXANDER H. BOONSTRA ET AL

It is certified that error appears in the above-identified patent and that said Letters Patent are hereby corrected as shown below:

On left hand column of title page there should be--[30] Foreign Application Priority Data October 31, 1977 (N.L.) Netherlands 7711927--.

Signed and Sealed this

*Fourth* Day of *October 1983*

[SEAL]

*Attest:*

GERALD J. MOSSINGHOFF

*Attesting Officer*

*Commissioner of Patents and Trademarks*